US009382499B2

(12) United States Patent
Komatsubara

(10) Patent No.: US 9,382,499 B2
(45) **Date of Patent: *Jul. 5, 2016**

(54) LUBRICATING OIL COMPOSITION

(71) Applicant: JX Nippon Oil & Energy Corporation, Tokyo (JP)

(72) Inventor: Hitoshi Komatsubara, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/388,276

(22) PCT Filed: Nov. 9, 2012

(86) PCT No.: PCT/JP2012/079113

§ 371 (c)(1),
(2) Date: Sep. 26, 2014

(87) PCT Pub. No.: WO2013/145413

PCT Pub. Date: Oct. 3, 2013

(65) Prior Publication Data

US 2015/0051127 A1 Feb. 19, 2015

(30) Foreign Application Priority Data

Mar. 29, 2012 (JP) ..... 2012-076091

(51) Int. Cl.

| | |
|---|---|
| ***C10M 135/36*** | (2006.01) |
| ***C10M 173/02*** | (2006.01) |
| ***C10M 135/22*** | (2006.01) |
| ***C10M 141/10*** | (2006.01) |

(52) U.S. Cl.

CPC ..... *C10M 141/10* (2013.01); *C10M 2203/1025* (2013.01); *C10M 2209/084* (2013.01); *C10M 2215/28* (2013.01); *C10M 2219/022* (2013.01); *C10M 2219/046* (2013.01); *C10M 2219/08* (2013.01); *C10M 2219/106* (2013.01); *C10M 2223/049* (2013.01); *C10N 2220/021* (2013.01); *C10N 2230/02* (2013.01); *C10N 2230/06* (2013.01); *C10N 2230/42* (2013.01); *C10N 2230/43* (2013.01); *C10N 2240/042* (2013.01); *C10N 2240/044* (2013.01); *C10N 2240/046* (2013.01); *C10N 2240/10* (2013.01); *C10N 2240/102* (2013.01); *C10N 2240/104* (2013.01); *C10N 2240/12* (2013.01); *C10N 2240/30* (2013.01)

(58) Field of Classification Search

CPC ..... C10M 2219/10; C10M 2223/041; C10M 2219/022

USPC ..... 508/272

See application file for complete search history.

(56) References Cited

U.S. PATENT DOCUMENTS

| | | | | |
|---|---|---|---|---|
| 2004/0167041 | A1 | 8/2004 | Arimoto | |
| 2004/0192562 | A1 | 9/2004 | Morita | |
| 2004/0214729 | A1 | 10/2004 | Buitrago | |
| 2006/0135378 | A1 | 6/2006 | Takahashi et al. | |
| 2007/0111906 | A1* | 5/2007 | Milner et al. | 508/343 |

FOREIGN PATENT DOCUMENTS

| | | | |
|---|---|---|---|
| EP | 2832830 | A1 | 2/2015 |
| JP | H10-25487 | A | 1/1998 |
| JP | H10-306292 | A | 11/1998 |
| JP | H11-50077 | A | 2/1999 |
| JP | 2000-063869 | A | 2/2000 |
| JP | 2000-355695 | A | 12/2000 |
| JP | 2001-323292 | A | 11/2001 |
| JP | 2002-105476 | A | 4/2002 |
| JP | 2003-113391 | A | 4/2003 |
| JP | 2004-323850 | A | 11/2004 |
| JP | 2007-238765 | A | 9/2007 |
| WO | 2004074414 | A1 | 9/2004 |

OTHER PUBLICATIONS

Int'l Search Report issued Feb. 12, 2013 in Int'l Application No. PCT/JP2012/079113.

Extended European Search Report issued Oct. 27, 2015 in EP Application No. 12872892.0.

* cited by examiner

*Primary Examiner* — Vishal Vasisth

(74) *Attorney, Agent, or Firm* — Panitch Schwarze Belisario & Nadel LLP

(57) ABSTRACT

The present invention provides a lubricating oil composition than can keep the metal-to-metal friction coefficient high and is excellent in anti-seizure properties. The lubricating oil composition comprises a base oil and on the basis of the total mass of the composition (A) 0.05 percent by mass or more of a polysulfide, (B) 0.05 percent by mass or more of thiadiazole and (C) 0.1 percent by mass or more of a phosphorus-containing additive, and containing sulfur in an amount of 0.2 percent by mass or more on the basis of sulfur and phosphorus in an amount of 0.2 percent by mass or less on the basis of phosphorus, the ratio of the sulfur basis percent by mass/the phosphorus basis percent by mass (S/P) being from 3.0 to 5.0.

4 Claims, No Drawings

LUBRICATING OIL COMPOSITION

CROSS-REFERENCE TO RELATED APPLICATION

This application is a Section 371 of International Application No. PCT/JP2012/079113, filed Nov. 9, 2012, which was published in the Japanese language on Oct. 3, 2013, under International Publication No. WO 2013/145413 A1, and the disclosure of which is incorporated herein by reference.

TECHNICAL FIELD

The present invention relates to lubricating oil compositions, particularly to a lubricating oil composition for metal belt type continuously variable transmissions.

BACKGROUND ART

Recent automatic transmissions or continuously variable transmissions have been demanded to be light and small and sought to be improved in power transmission capability in connection with the increased power output of the engines with which the transmissions are used in combination. The reduction in weight and size is intended to improve the fuel efficiency of the vehicles in which the transmissions are mounted.

In particular, in the case of a metal belt type continuously variable transmission, it can be reduced in size if the friction coefficient between the belt and pulleys and thus lubricating oil to be used therein is preferably an oil having properties to keep the metal-to-metal friction coefficient high.

Furthermore, the lubricating oil has also been demanded to reduce the fuel consumption. Specifically, a lubricating oil contributes to improvement in fuel economy by reducing its viscosity, stir resistance or viscous resistance upon idling of a clutch pack, or fluid film lubrication, resulting in a reduction in power loss.

A transmission fluid has been proposed, in which a friction modifier, a metallic detergent, an ashless dispersant, and an anti-wear agent are optimally added so as to retain the friction characteristics of a lock-up clutch in a good condition and provide long-lasting initial anti-shudder properties (see Patent Literatures 1 to 7 below).

For example, Patent Literature 1 discloses a transmission lubricating oil composition comprising a specific calcium salicylate, an SP-based extreme pressure additive, a specific succinimide and a boron-containing ashless dispersant, each in a specific amount, which composition exhibits excellent properties such as excellent anti-shudder properties and long-lasting fatigue life. Patent Literature 2 discloses a continuously variable transmission lubricating oil composition containing an organic acid metal salt with a specific composition, an anti-wear agent, and a boron-containing succinimide, as essential components, to have both higher metal-to metal friction coefficient and anti-shudder properties for a slip control mechanism. Patent Literature 3 discloses a long-lasting continuously variable transmission lubricating oil composition comprising calcium salicylate, a phosphorous-containing anti-wear agent, a friction modifier, and a dispersant type viscosity index improver, to have both a higher metal-to metal friction coefficient and anti-shudder properties for a slip control mechanism. Patent Literature 4 discloses a lubricating oil composition comprising a dithiocarbamate compound, a condensate of a branched fatty acid having 8 to 30 carbon atoms and amine, and an amine-based anti-oxidant, to have excellent and long-lasting anti-shudder properties. Patent Literature 5 discloses an automatic transmission fluid composition comprising calcium sulfonate, phosphorous acid esters and further a sarcosine derivative or a reaction product of a carboxylic acid and amine, to have long-lasting anti-shudder properties for a slip lock-up mechanism and long-lasting properties to prevent scratch noise in a belt type continuously variable transmission. Patent Literature 6 discloses an automatic transmission fluid composition comprising a specific alkaline earth metal sulfonate in a specific amount, which composition is excellent in oxidation stability as a fluid used for an automatic transmission with a slip control mechanism and has long-lasting anti-shudder properties. Patent Literature 7 discloses an automatic transmission fluid comprising calcium salicylate, magnesium salicylate, a specific amount of a friction modifier and a specific amount of a boric acid-modified succinimide, with excellent anti-shudder properties and a certain torque capacity.

CITATION LIST

Patent Literature

Patent Literature 1: Japanese Patent Application Laid-Open Publication No. 2003-113391

Patent Literature 2: Japanese Patent Application Laid-Open Publication No. 2001-323292

Patent Literature 3: Japanese Patent Application Laid-Open Publication No. 2000-355695

Patent Literature 4: Japanese Patent Application Laid-Open Publication No. 11-50077

Patent Literature 5: Japanese Patent Application Laid-Open Publication No. 10-306292

Patent Literature 6: Japanese Patent Application Laid-Open Publication No. 10-25487

Patent Literature 7: Japanese Patent Application Laid-Open Publication No. 2000-63869

SUMMARY OF INVENTION

Technical Problem

However, when the viscosity reduction is facilitated, oil film at lubricating sites becomes thinner and thus wear and seizure likely occur. Therefore, the present invention has an object to provide a lubricating oil composition which keep the metal-to-metal friction coefficient higher so that while the torque capacity is maintained, anti-wear and anti-seizure properties are enhanced even though the viscosity is reduced, particularly suitable as a metal belt type continuously variable transmissions fluid.

Solution to Problem

As the results of extensive studies conducted by the inventors of the present invention to achieve the above object, the present invention was accomplished on the basis of the finding that the above object was able to be achieved with a lubricating oil composition containing a specific sulfur-containing additive and a specific phosphorus-containing additive each in a specific amount and a specific ratio.

That is, the present invention is a lubricating oil composition comprising a base oil and on the basis of the total mass of the composition (A) 0.05 percent by mass or more of a polysulfide, (B) 0.05 percent by mass or more of thiadiazole and (C) 0.1 percent by mass or more of a phosphorus-containing additive, and containing sulfur in an amount of 0.2 percent by mass or more on the basis of sulfur and phosphorus in an amount of 0.2 percent by mass or less on the basis of phosphorus, the ratio of the sulfur basis percent by mass/the phosphorus basis percent by mass (S/P) being from 3.0 to 5.0.

In the above lubricating oil composition, (A) the polysulfide is preferably a sulfurized olefin represented by formula (1):

$$R^1—S_x—R^2 \quad (1)$$

(wherein $R^1$ is an alkenyl group having 2 to 15 carbon atoms, $R^2$ is an alkyl or alkenyl group having 2 to 15 carbon atoms, and x is an integer of 4 to 8.)

In the above lubricating oil composition, (C) the phosphorus-containing additive is a phosphorous acid ester having an (alkyl)aryl group of 6 to 7 carbon atoms and/or a phosphorous acid ester having an alkyl group of 4 to 8 carbon atoms.

Advantageous Effect of Invention

The lubricating oil composition of the present invention can keep the metal-to-metal friction coefficient high and is excellent in anti-seizure properties, particularly suitable for belt type continuously variable transmissions.

The lubricating oil composition of the present invention is also excellent in performances required for transmission fluids other than those described above and thus is suitably used for the automatic or manual transmission and the differential gears, of automobiles, construction machines and agricultural machines. Moreover, the lubricating oil composition can be used as gear oils for industrial uses; lubricating oils for the gasoline engines, diesel engines or gas engines of automobiles such as two- and four-wheeled vehicles, power generators, and ships; turbine oils; and compressor oils.

DESCRIPTION OF EMBODIMENTS

The present invention will be described in detail below.

No particular limitation is imposed on the lubricating base oil of the lubricating oil composition of the present invention, which may be a mineral base oil or synthetic base oil that is usually used in lubricating oil.

Specific examples of the mineral base oil include those which can be produced by subjecting a lubricating oil fraction produced by vacuum-distilling an atmospheric distillation bottom oil resulting from atmospheric distillation of a crude oil, to any one or more treatments selected from solvent deasphalting, solvent extraction, hydrocracking, solvent dewaxing, and hydrorefining; wax-isomerized mineral oils; and those produced by a technique for isomerizing GTL WAX (Gas to Liquid Wax).

The mineral based oil used in the present invention is preferably a hydrocracked mineral base oil. Alternatively, the mineral base oil is preferably a wax-isomerized isoparaffin base oil, which is produced by isomerizing a raw material oil containing 50 percent by mass or more of wax such as a petroleum-based wax or Fischer-Tropsch synthetic oil. Although these base oils may be used alone or in combination, a sole use of a wax-isomerized base oil is preferable.

Specific examples of the synthetic base oils include polybutenes and hydrogenated compounds thereof; poly-α-olefins such as 1-octene oligomer, 1-decene oligomer and 1-dodecene oligomer or hydrogenated compounds thereof; diesters such as ditridecyl glutarate, di-2-ethylhexyl adipate, diisodecyl adipate, ditridecyl adipate and di-2-ethylhexyl sebacate; polyol esters such as neopentylglycol ester, trimethylolpropane caprylate, trimethylolpropane pelargonate, pentaerythritol 2-ethylhexanoate and pentaerythritol pelargonate; aromatic synthetic oils such as alkylnaphthalenes, alkylbenzenes, and aromatic esters; and mixtures of the foregoing.

The lubricating base oil used in the present invention may be any one of the above-described mineral base oils and synthetic base oils or a mixture of two or more types selected therefrom. For example, the base oil may be one or more type of the mineral base oils, one or more type of the synthetic base oils or a mixed oil of one or more type of the mineral base oils and one or more type of the synthetic base oils.

No particular limitation is imposed on the kinematic viscosity of the lubricating base oil of the present invention. However, the lubricating base oil is preferably so adjusted that the 100° C. kinematic viscosity is preferably from 2 to 8 $mm^2/s$, more preferably from 2.5 to 6 $mm^2/s$, particularly preferably from 3 to 4.5 $mm^2/s$. A base oil with a 100° C. kinematic viscosity of greater than 8 $mm^2/s$ is not preferable because the resulting lubricating oil composition would be poor in low temperature viscosity characteristics while a base oil with a 100° C. kinematic viscosity of less than 2 $mm^2/s$ is not also preferable because the resulting lubricating oil composition would be poor in lubricity due to its insufficient oil film formation at lubricating sites and large in evaporation loss of the lubricating base oil.

No particular limitation is imposed on the viscosity index of the lubricating base oil, which is, however, preferably 100 or greater, more preferably 120 or greater, more preferably 130 or greater, particularly preferably 140 or greater and usually 200 or less, preferably 160 or less. The use of a lubricating base oil having a viscosity index of greater than 100 renders it possible to produce a composition exhibiting excellent viscosity characteristics from low temperatures to high temperatures. Whilst, if the viscosity index is too high, the resulting composition would tend to be high in viscosity at low temperatures.

In order to improve the low temperature viscosity characteristics and viscosity index of the lubricating oil composition, the base oil is preferably a combination of two or more base oils having a viscosity index of 120 or greater selected from low viscosity base oils having a viscosity index of 115 or greater and a 100° C. kinematic viscosity of 2 $mm^2/s$ or higher and lower than 3.5 $mm^2/s$ and relatively high viscosity base oils having a viscosity index of 125 or greater and a 100° C. kinematic viscosity of 3.5 $mm^2/s$ or higher and 4.5 $mm^2/s$ or lower. In particular, mixing these base oils can enhance the viscosity index so that the −40° C. Brookfield viscosity is 10000 mPa·s or lower.

The viscosity index of the above-described low viscosity base oil is preferably 120 or greater, more preferably 125 or greater and the viscosity index of the relatively high viscosity base oil is preferably 130 or greater, more preferably 135 or greater so that the −40° C. Brookfield viscosity can be 8000 mPa·s or lower.

No particular limitation is imposed on the sulfur content of the lubricating base oil used in the present invention, which is, however, preferably 0.1 percent by mass or less, more preferably 0.05 percent by mass or less, more preferably 0.01 percent by mass or less, particularly preferably 0.005 percent by mass or less, most preferably substantially 0. A composition with excellent oxidation stability can be produced by reducing the sulfur content of the lubricating base oil.

No particular limitation is imposed on the evaporation loss of the lubricating base oil. However, the NOACK evaporation loss is preferably from 10 to 50 percent by mass, more preferably from 20 to 40 percent by mass, particularly preferably from 22 to 35 percent by mass. The use of a lubricating base oil with a NOACK evaporation loss adjusted within the above ranges renders it possible to achieve both low temperature characteristics and anti-wear properties. The term "NOACK evaporation loss" used herein denotes an evaporation loss measured in accordance with CEC L-40-T-87.

Examples of Component (A), that is a polysulfide used in the present invention include sulfurized fats and oils, sulfurized olefins, dihydrocarbyl polysulfides.

Examples of the sulfurized fats and oils include oils such as sulfurized lard, sulfurized rapeseed oil, sulfurized ricinus oil, sulfurized soybean oil, and sulfurized rice bran oil; disulfurized fatty acids such as sulfurized oleic acid; and sulfurized esters such as sulfurized oleic methyl oleate.

Examples of the sulfurized olefin include compounds represented by formula (1):

$$R^1—S_x—R^2 \quad (1)$$

wherein $R^1$ is an alkenyl group having 2 to 15 carbon atoms, $R^2$ is an alkyl or alkenyl group having 2 to 15 carbon atoms, x is an integer of 1 to 8, preferably 2 or greater, particularly preferably 4 or greater.

The compounds can be produced by reacting an olefin having 2 to 15 carbon atoms or a dimer to tetramer thereof with sulfur or a sulfurizing agent such as sulfur chloride.

Such an olefin is preferably propylene, isobutene, or diisobutene.

The dihydrocarbyl polysulfide is a compound represented by formula (2):

$$R^3—S_y—R^4 \quad (2).$$

In formula (2), $R^3$ and $R^4$ are each independently an alkyl (including cycloalkyl) group having 1 to 20 carbon atoms, an aryl group having 6 to 20 carbon atoms, or an arylalkyl or alkylaryl group having 7 to 20 carbon atoms and may be the same or different from each other, and y is an integer of 2 to 8.

Specific examples of $R^3$ and $R^4$ include methyl, ethyl, n-propyl, isopropyl, n-butyl, isobutyl, sec-butyl, tert-butyl, various pentyls, various hexyls, various heptyls, various octyls, various nonyls, various decyls, various dodecyls, cyclohexyl, phenyl, naphthyl, tolyl, xylyl, benzyl, and phenetyl groups.

Preferred examples of the dihydrocarbyl polysulfide include dibenzyl polysulfide, di-tert-nonylpolysulfide, didodccylpolysulfide, di-tert-butylpolysulfide, dioctylpolysulfide, diphenylpolysulfide, and dicyclohexylpolysulfide.

Component (A), i.e., polysulfide used in the present invention is preferably a sulfurized olefin, most preferably that represented by formula (1) wherein x is an integer of 4 to 8.

In the present invention, Component (A) is added in an amount of 0.05 percent by mass or more, preferably 0.1 percent by mass or more and preferably 1.5 percent by mass or less, more preferably 1.2 percent by mass or less, more preferably 1 percent by mass or less, most preferably 0.5 percent by mass or less on the basis of the total mass of the lubricating oil composition with the objective of improving the metal to metal friction coefficient and in view of anti-wear properties and anti-seizure properties. If the amount of Component (A) exceeds 1.5 percent by mass, the resulting composition would be largely degraded in oxidation stability.

No particular limitation is imposed on the structure of Component (B) used in the present invention if it is a thiadiazole. Examples of such a thiadiazole include a 1,3,4-thiziazole compound represented by formula (3) below, a 1,2,4-thiadiazole compound represented by formula (4) below and a 1,4,5-thidiazole compound represented by formula (5) below.

(3)

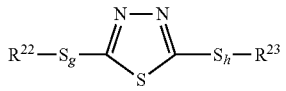

(4)

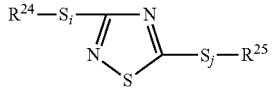

(5)

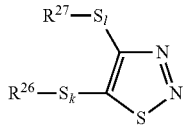

In formulas (3) to (5), $R^{22}$, $R^{23}$, $R^{24}$, $R^{25}$, $R^{26}$ and $R^{27}$ may be the same or different from one another and are each independently hydrogen or a hydrocarbon group having 1 to 30 carbon atoms, and g, h, i, j, k and l are each independently an integer of 0 to 8.

Examples of the hydrocarbon group having 1 to 30 carbon atoms include alkyl, cycloalkyl, alkylcycloalkyl, alkenyl, aryl, alkylaryl and arylalkyl groups.

In the present invention, Component (B) is added in an amount of 0.05 percent by mass or more, preferably 0.1 percent by mass or more and preferably 1.5 percent by mass or less, more preferably 1.2 percent by mass or less, more preferably 1 percent by mass or less, most preferably 0.5 percent by mass or less on the basis of the total mass of the lubricating oil composition with the objective of improving the metal to metal coefficient and in view of anti-wear properties and anti-seizure properties. If the amount of Component (B) exceed 1.5 percent by mass, the resulting composition would be degraded in anti-seizure properties to the contrary.

The lubricating oil composition of the present invention comprises a phosphorus-containing additive as Component (C).

No particular limitation is imposed on the phosphorus-containing additive if it contains phosphorus in its molecule. Examples of the phosphorus-containing additive include phosphoric acid monoesters, phosphoric acid diesters, phosphoric acid triesters, phosphorus acid monoesters, phosphorus acid diesters, phosphorus acid triesters, thiophosphoric acid monoesters, thiophosphoric acid diesters, thiophosphoric acid triesters, thiophosphorus acid monoesters, thiophosphorus acid diesters, thiophosphorus acid triesters, all having a hydrocarbon group of 1 to 30 carbon atoms, salts of these esters and amines or alkanol amines or metal salts such as zinc salt of these esters.

Examples of the hydrocarbon group having 1 to 30 carbon atoms include alkyl, cycloalkyl, alkenyl, alkyl-substituted cycloalkyl, aryl, alkyl-substituted aryl and arylalkyl groups. One or more type of the groups may be contained in the additive.

In the present invention, the phosphorus-containing additive is preferably a phosphorus acid ester or phosphoric acid ester, having an alkyl group of 4 to 20 carbon atoms or an (alkyl)aryl group of 6 to 12 carbon atoms.

Alternatively, the phosphorus-containing additive is more preferably one or a mixture of two or more types selected from phosphorus acid esters having an alkyl group of 4 to 20 carbon atoms and phosphorus acid esters having an (alkyl) aryl group of 6 to 12 carbon atoms.

Furthermore, the phosphorus-containing additive is more preferably a phosphorus acid ester having an (alkyl)aryl group of 6 to 7 carbon atoms such as phenylphosphite and/or a phosphorus acid ester having an alkyl group of 4 to 8 carbon atoms. Among these phosphorus-containing additives, dibutylphosphite is most preferable.

The alkyl group may be straight-chain but is more preferably branched. This is because alkyl groups of fewer carbon atoms or branched result in higher metal-to-metal friction coefficient.

The content of the phosphorus-containing additive in the lubricating oil composition of the present invention is 0.1 percent by mass or more, usually from 0.1 to 5 percent by mass on the basis of the total mass of the lubricating oil composition.

The content is preferably from 0.001 to 0.2 percent by mass on the phosphorus concentration basis. With the objective of further enhancing anti-wear properties for metal materials and metal-to-metal friction coefficient, the content is preferably 0.005 percent by mass or more, more preferably 0.01 percent by mass or more, particularly preferably 0.02 percent by mass or more. Whilst, the content is preferably 0.15 percent by mass or less, more preferably 0.1 percent by mass or less, particularly preferably 0.08 percent by mass or less. If the content exceeds 0.2 percent by mass, the lubricating oil composition would be degraded in oxidation stability or adversely affect sealing materials.

The sulfur content in the lubricating oil composition of the present invention is 0.2 percent by mass or more on the sulfur basis. The phosphorus content in the composition is necessarily 0.2 percent by mass or less on the phosphorus basis.

The ratio of the sulfur content by percent by mass on the sulfur basis and the phosphorus content by percent by mass on the phosphorus basis (the ratio of the sulfur basis percent by mass/the phosphorus basis percent by mass (S/P)) in the composition is necessarily from 3.0 to 5.0.

Adjusting the mass ratio of the phosphorus-containing additive content on the phosphorus basis (P) to the sulfur content in the lubricating oil composition (S) to the above-described range renders it possible to produce a lubricating oil composition which has long-lasting anti-wear properties and anti-seizure properties while keeping the metal-to-metal friction coefficient higher. In particular, if the S/P ratio exceeds 5.0, the anti-seizure properties would be degraded. This is assumed to be caused by different action mechanisms to anti-seizure properties between the phosphorus-containing additive and sulfur-containing additive, and the balance therebetween has been found important.

In the present invention, a friction modifier and/or a metallic detergent may be blended alone or in combination. Blending of these additives in the lubricating oil composition of the present invention renders it possible to produce a lubricating oil composition which is more suitable for a belt type continuously variable transmission equipped with a wet friction clutch.

The friction modifier that can be used in combination with the lubricating oil composition of the present invention may be any compound that is usually used as a friction modifier for lubricating oil. Examples of such a compound include amine compounds, fatty acid amides and fatty acid metal salts, each having in their molecules an alkyl or alkenyl group having 6 to 30 carbon atoms, particularly a straight-chain alkyl or alkenyl group having 6 to 30 carbon atoms.

The above-exemplified amine compounds include succinimides that are reaction products with polyamines. These include those modified with a boric compound or a phosphorus compound.

Examples of the amine compound include straight-chain or branched, preferably straight-chain aliphatic monoamines and aliphatic polyamines, each having 6 to 30 carbon atoms, alkyleneoxide adducts of these aliphatic amines, salts of these amine compounds and phosphoric acid esters or phosphorus acid esters, and boric acid-modified products of (phosphorus) phosphoric acid ester salts of these amine compounds.

Particularly preferred are alkyleneoxide adducts of amine compounds; salts of these amine compounds and phosphoric acid esters (for example, di-2-ethylhexylphosphate), phosphorus acid esters (for example, di-2-ethylhexylphosphate); boric acid-modified products of (phosphorus)phosphoric acid ester salts of these amine compounds; and mixtures thereof.

Examples of the fatty acid amide include amides of straight-chain or branched, preferably straight-chain fatty acid having 7 to 31 carbon atoms and aliphatic monoaminse or aliphatic polyamines. Specific examples include lauric acid amide, lauric acid diethanol amide, lauric acid monopropanol amide, myristic acid amide, myristic acid diethanol amide, myristic acid monopropanol amide, palmitic acid amide, palmitic acid diethanol amide, palmitic acid monopropanol amide, stearic acid amide, stearic acid diethanol amide, stearic acid monopropanol amide, oleic acid amide, oleic acid diethanol amide, oleic acid monopropanol amide, coconut oil fatty acid amide, coconut oil fatty acid diethanol amide, coconut oil fatty acid monopropanol amide, synthetic mixed fatty acid amide having 12 or 13 carbon atoms, synthetic mixed fatty acid diethanol amide having 12 or 13 carbon atoms, and mixtures thereof.

Examples of the fatty acid metal salt include alkaline earth metal salts (magnesium salt, calcium salt) and zinc salts of straight-chain or branched, preferably straight-chain fatty acids having 7 to 31 carbon atoms. More specifically, particularly preferred are calcium laurate, calcium myristate, calcium palmitate, calcium stearate, calcium oleate, coconut oil fatty acid calcium, a synthetic mixed fatty acid calcium having 12 or 13 carbon atoms, zinc laurate, zinc myristate, zinc palmitate, zinc stearate, zinc oleate, coconut oil fatty zinc, a synthetic mixed fatty zinc having 12 or 13 carbon atoms, and mixtures thereof.

In the present invention, any one or more type of compound selected from these friction modifiers may be blended in any amount but the content thereof is usually preferably from 0.01 to 5 percent by mass, more preferably from 0.03 to 3 percent by mass on the basis of the total mass of the lubricating oil composition.

The metallic detergent that can be used in combination with the lubricating oil composition of the present invention is any compound that is usually used as a metallic detergent for lubricating oil. For example, alkali metal or alkaline earth metal sulfonates, phenates, salicylates and naphthenates may be used in combination. Examples of the alkali metal include sodium and potassium. Examples of the alkaline earth metal include calcium and magnesium. More specifically, the metallic detergent are preferably calcium or magnesium sulfonate, phenate and salicylate. Among these detergents, calcium sulfonate is preferably used.

The total base number of these metallic detergents is from 0 to 500 mgKOH/g, and the content thereof is preferably 0.001 to 0.5 percent by mass on the alkali metal or alkaline earth metal basis on the basis of the total mass of the lubricating oil composition. The upper limit is preferably 0.1 percent by mass, particularly preferably 0.05 percent by mass or less with the objective of preventing the friction coefficient from reducing due to clogging of the friction material of a clutch plate.

In order to further enhance the properties of the lubricating oil composition of the present invention, it may be blended with any one or more of conventional lubricating oil additives, such as ashless dispersants, viscosity index improvers, anti-oxidants, corrosion inhibitors, anti-foaming agents and colorants.

The ashless dispersants that can be used in combination with the lubricating oil composition of the present invention may be any compounds that are used as ashless dispersants for lubricating oil. Examples of such compounds include nitrogen-containing compounds having in their molecules at least one alkyl or alkenyl group having 40 to 400, preferably 60 to 350 carbon atoms, bis-type or mono-type succinimides having an alkenyl group having 40 to 400 carbon atoms, preferably 60 to 350 carbon atoms, and modified products produced by allowing these compounds to react with boric acid, phosphoric acid, carboxylic acid or derivatives thereof, or a sulfur compound. Any one or more of these compounds may be used in combination.

The alkyl or alkenyl group referred herein may be straight-chain or branched but is preferably a branched alkyl or alkenyl group derived from oligomers of olefins such as propylene, 1-butene or isobutylene or a cooligomer of ethylene and propylene. The alkyl or alkenyl group is preferably polybutenyl group derived from polymers produced by polymerizing a butene mixture or a high purity isobutylene with an aluminum chloride-based catalyst or a boron fluoride-based catalyst, particularly preferably those from which a halogen compound is removed.

If the carbon number of the alkyl or alkenyl group is fewer than 40, the ashless dispersant would be poor in detergent dispersibility. Whilst, if the carbon number of the alkyl or alkenyl group exceeds 400, the resulting lubricating oil composition would be degraded in low temperature fluidity. Although the content of these compounds are arbitrarily selected, it is preferably from 0.1 to 10 percent by mass, more preferably 1 to 8 percent by mass on the basis of the total mass of the lubricating oil composition. The ashless dispersants that may be used in combination in the present invention are particularly preferably succinimides having a polybutenyl group and a weight-average molecular weight of 700 to 3,500, preferably 900 to 2,000 and/or boric acid-modified compounds thereof with the objective of further improving shifting properties. With the objective of enhancing the ability to avoid the peel-off of a wet clutch, the ashless dispersants are blended with preferably a boric acid-modified succinimide, more preferably a boric acid-modified succinimide as one type of component.

Specific examples of viscosity index improvers that can be used in combination with the lubricating oil composition of the present invention include non-dispersant type viscosity index improvers such as copolymers of one or more monomers selected from various methacrylic acid esters or hydrogenated compounds thereof; and dispersant type viscosity index improvers such as copolymers of various methacrylic acid esters further containing nitrogen compounds. Specific examples of other viscosity index improvers include non-dispersant- or dispersant-type ethylene-α-olefin copolymers of which α-olefin may be propylene, 1-butene, or 1-pentene, or a hydrogenated compound thereof; polyisobutylenes or hydrogenated compounds thereof; styrene-diene hydrogenated copolymers; styrene-maleic anhydride ester copolymers; and polyalkylstyrenes.

The molecular weight of these viscosity index is necessarily selected, taking account of the shear stability thereof. Specifically, the number-average molecular weight of the non-dispersant or dispersant type polymethacrylate is from 5,000 to 150,000, preferably from 5,000 to 35,000. The number-average molecular weight of polyisobutylenes or hydrogenated compounds thereof is from 800 to 5,000, preferably from 1,000 to 4,000. The number-average molecular weight of ethylene-α-olefin copolymers or hydrogenated compounds thereof is from 800 to 150,000, preferably from 3,000 to 12,000. Among these viscosity index improvers, the use of ethylene-α-olefin copolymers or hydrogenated compounds thereof renders it possible to produce a lubricating oil composition which is particularly excellent in shear stability. One or more compounds selected from these viscosity index improvers may be blended in any amount in the lubricating oil composition of the present invention. However, the content of the viscosity index improver is usually from 0.1 to 40.0 percent by mass, on the basis of the total amount of the composition.

The anti-oxidant may be any anti-oxidant that has been usually used in lubricating oil, such as phenol- or amine-based compounds. Specific examples of the anti-oxidant include alkylphenols such as 2-6-di-tert-butyl-4-methylphenol; bisphenols such as methylene-4,4-bisphenol(2,6-di-tert-butyl-4-methylphenol); naphthylamines such as phenyl-α-naphthylamine; dialkyldiphenylamines; zinc dialkyldithiophosphoric acids such as di-2-ethylhexyldithiophosphoric acid; and esters of (3,5-di-tert-butyl-4-hydroxyphenyl) fatty acid (propionic acid) with a monohydric or polyhydric alcohol such as methanol, octadecanol, 1,6-hexanediol, neopentyl glycol, thiodiethylene glycol, triethylene glycol and pentaerythritol. Any one or more of compounds selected from these compounds may be contained in any amount, which is, however, usually from 0.01 to 5 percent by mass on the total composition mass basis.

The corrosion inhibitors that can be used in combination with the lubricating oil composition of the present invention may be any compounds that have been usually used as corrosion inhibitors for lubricating oil. Examples of such compounds include benzotriazole-, tolyltriazole-, thiadiazole-, and imidazole-types compounds. Any one or more of compounds selected from these compounds may be contained in any amount, which is, however, usually from 0.01 to 3.0 percent by mass on the total composition mass basis.

The anti-foaming agent that can be used in combination with the lubricating oil composition of the present invention may be any compounds that have been usually used as anti-foaming agents for lubricating oil. Examples of such compounds include silicones such as dimethylsilicone and fluorosilicone. Any one or more of compounds selected from these compounds may be contained in any amount, which is, however, usually from 0.001 to 0.05 percent by mass on the total composition mass basis.

The colorants that may be used in combination with the transmission lubricating oil composition of the present invention may be any colorants and contained in any amount, which is, however, desirously from 0.001 to 1.0 percent by mass on the basis of the total mass of the lubricating oil composition.

EXAMPLES

Hereinafter, the present invention will be described in more detail by way of the following examples and comparative examples, which should not be construed as limiting the scope of the invention.

Examples 1 to 6 and Comparative Examples 1 to 8

Lubricating oil compositions of Example 1 to 6 and Comparative Examples 1 to 8 set forth in Table 1 were prepared and subjected to the following tests, the results of which are also set forth in Table 1. In Table 1, the ratio of the base oils is based on the total mass of the base oil and the amount of each additive is based on the total mass of the composition.

(1) Last non-seizure load (LNSL) evaluated by Four-Ball Extreme Pressure Test Method in accordance with ASTM D2783

(2) Wear scar diameter evaluated by Four-Ball Extreme Pressure Test Method in accordance with ASTM D4172

(3) Seizure load evaluated by Falex Seizure test in accordance with ASTM D3233

(4) Metal-to-metal friction coefficient evaluated by LFW-1 Test in accordance with JASO Method (High Load Method) M358:2005

TABLE 1

| | | Example 1 | Example 2 | Example 3 | Example 4 | Example 5 | Example 6 | Comparative Example 1 | Comparative Example 2 |
|---|---|---|---|---|---|---|---|---|---|
| Base oil A-1a (on basis of the base oil total mass) | mass % | 65 | 65 | 65 | 65 | 65 | 65 | 65 | 65 |
| Base oil A-1b (on basis of the base oil total mass) | mass % | 35 | 35 | 35 | 35 | 35 | 35 | 35 | 35 |
| Additive composition (on the basis of the composition mass basis) | | | | | | | | | |
| (A)-1 | mass % | 0.13 | 0.10 | 0.36 | 0.13 | | | | 0.13 |
| (A)-2 | mass % | | | | | 0.28 | | | |
| (A)-3 | mass % | | | | | | 0.22 | | |
| (B)-1 | mass % | 0.20 | 0.20 | 0.11 | 0.20 | 0.20 | 0.20 | | 1.73 |
| (C)-1 | mass % | 0.32 | 0.19 | 0.45 | | 0.32 | 0.32 | | 0.58 |
| (C)-2 | mass % | | | | 0.33 | | | | |
| (C)-3 | mass % | | | | | | | | |
| Viscosity index improver a | mass % | 15 | 15 | 15 | 15 | 15 | 15 | 15 | 15 |
| Viscosity index improver b | mass % | 2 | 2 | 2 | 2 | 2 | 2 | 2 | 2 |
| Performance additive D-1 | mass % | 6 | 6 | 6 | 6 | 6 | 5 | 6 | 6 |
| Sulfur and phosphorus contents in composition | | | | | | | | | |
| Sulfur basis amount | mass % | 0.25 | 0.24 | 0.28 | 0.25 | 0.25 | 0.25 | 0.14 | 0.80 |
| Phosphorus basis amount | mass % | 0.07 | 0.05 | 0.09 | 0.07 | 0.07 | 0.07 | 0.02 | 0.11 |
| Sulfur/phosphorus (S/P) ratio | | 3.6 | 4.8 | 3.1 | 3.6 | 3.6 | 3.6 | 7 | 7.2 |
| Four-Ball Extreme Pressure Test 1800 rpm LNSL | N | 981 | 981 | 981 | 785 | 618 | 618 | 490 | 981 |
| Wear scar diameter | mm | 0.39 | 0.43 | 0.43 | 0.42 | 0.58 | 0.50 | 0.55 | 0.63 |
| Falex seizure test | lb | 1210 | 1680 | 1270 | 1200 | 1170 | 1190 | 640 | 990 |
| LSW-1 test (friction coefficient) | 0.5 m/s | 0.132 | 0.130 | 0.137 | 0.128 | 0.128 | 0.128 | 0.113 | 0.142 |
| BF viscosity @−40° C. | | 7200 | 7450 | 8100 | 7500 | 7340 | 7600 | 6980 | 8050 |

| | | Comparative Example 3 | Comparative Example 4 | Comparative Example 5 | Comparative Example 6 | Comparative Example 7 | Comparative Example 8 |
|---|---|---|---|---|---|---|---|
| Base oil A-1a (on basis of the base oil total mass) | mass % | 65 | 65 | 65 | 65 | 65 | 55 |
| Base oil A-1b (on basis of the base oil total mass) | mass % | 35 | 35 | 35 | 35 | 35 | 35 |
| Additive composition (on the basis of the composition mass basis) | | | | | | | |
| (A)-1 | mass % | | | 0.10 | 0.13 | 0.13 | 0.03 |
| (A)-2 | mass % | | | | | | |
| (A)-3 | mass % | | | | | | |
| (B)-1 | mass % | | 0.20 | | | | 0.20 |
| (C)-1 | mass % | 0.13 | 0.19 | 0.19 | | | 0.45 |
| (C)-2 | mass % | | | | 0.33 | | |
| (C)-3 | mass % | | | | | 0.77 | |
| Viscosity index improver a | mass % | 15 | 15 | 15 | 15 | 15 | 15 |
| Viscosity index improver b | mass % | 2 | 2 | 2 | 2 | 2 | 2 |
| Performance additive D-1 | mass % | 6 | 6 | 6 | 6 | 6 | 6 |
| Sulfur and phosphorus contents in composition | | | | | | | |
| Sulfur basis amount | mass % | 0.14 | 0.21 | 0.17 | 0.25 | 0.25 | 0.22 |
| Phosphorus basis amount | mass % | 0.04 | 0.05 | 0.05 | 0.07 | 0.07 | 0.09 |
| Sulfur/phosphorus (S/P) ratio | | 3.5 | 4.2 | 3.4 | 3.6 | 3.6 | 2.4 |
| Four-Ball Extreme Pressure Test 1800 rpm LNSL | N | 392 | 618 | 618 | 785 | 490 | 618 |
| Wear scar diameter | mm | 0.53 | 0.44 | 0.50 | 0.42 | 0.67 | 0.41 |
| Falex seizure test | lb | 910 | 980 | 1070 | 980 | 990 | 980 |

TABLE 1-continued

| | | | | | | | |
|---|---|---|---|---|---|---|---|
| LSW-1 test (friction coefficient) | 0.5 m/s | 0.117 | 0.122 | 0.123 | 0.122 | 0.118 | 0.121 |
| BF viscosity @−40° C. | | 6900 | 7100 | 7100 | 7150 | 7600 | 7000 |

Base oil A-1a 40° C.: 15.65 $mm^2/s$, 100° C.: 3.883, VI: 142, sulfur content: 4 mass ppm
Base oil A-1b 40° C.: 9.072 $mm^2/s$, 100° C.: 2.621 $mm^2/s$, VI: 127, sulfur contet: 4 mass ppm
(A)-1: sulfurized olefin (active) R-$S_x$-R(X ≥ 4) sulfur content: 30.5%
(A)-2: sulfurized olefin (inactive) R-$S_x$-R(4 > X) sulfur content: 14.5%
(A)-3: sulfurized ester (active) R-$S_x$-R(X ≥ 4) sulfur content: 18.0%
(B)-1: thiadiazole sulfur content: 36.0% (1,3,4-thiadiazole compound)
(C)-1: dibutylphosphite P content: 15.5%
(C)-2: diphenylhydrogen phosphite P content: 13.2%
(C)-3: dilaurylhydrogen phosphite P content: 6.5%
Viscosity index improver a: polymethacrylate weight-average molecular weight (Mw): 20000
Viscosity index improver, b: polymethacrylate weight-average molecular weight (Mw): 50000
Performance additive: additive package for main additives: boron-containing succinimide, amount 3 mass %, metallic detergent: sulfonate (300BN), continuously variable transmission amount 0.32 mass % (Ca concentration in oil 380 mass ppm), diluting oil and the like As seen from Table 1, the compositions of Comparative Examples 1, 3 and 4 containing no (A) polysulfide and Comparative Example 8 containing (A) in an amount of less than 0.05 percent by mass tend to be lower in last non-seizure load (LNSL) evaluated by Four-Ball Extreme Pressure Test than the lubricating oil compositions of Examples and are apparently lower in anti-seizure load. The compositions of these comparative examples are lower in metal-to-metal friction coefficient evaluated by LFW-1 Test affecting their torque capacities.

The compositions of Comparative Examples 1, 3 and 5 to 7 containing no (B) thiadiazole are found to be lower in metal-to-metal friction coefficient evaluated by LFW-1 Test than those of Examples and thus lower in torque capacity.

The composition of Comparative Example 1 containing no (C) phosphorus-containing additive tends to be lower in last non-seizure load (LNSL) evaluated by Four-Ball Extreme Pressure Test than the lubricating oil compositions of Examples and is apparently lower in anti-seizure load evaluated in Falex Seizure Test. The composition of this comparative examples is lower in metal-to-metal friction coefficient evaluated by LFW-1 Test affecting their torque capacities.

Although in the present invention, the sulfur content on the sulfur basis in the composition is importantly 0.2 percent by mass or more, the compositions of Comparative Examples 1 and 3, the content of sulfur of which is less than the content defined by the present invention are lower in metal-to-metal friction coefficient evaluated by LFW-1 Test. Furthermore, in the present invention, importantly the phosphorus content on the phosphorus basis in the composition is 0.2 percent by mass or less, and the sulfur basis percent by mass/the phosphorus basis percent by mass (S/P) is from 3.0 to 5.0, but the composition of Comparative Example 1 deviating this range are as described above. The composition of Comparative Example 2 is sufficiently high in metal-to-metal friction coefficient but large in wear in Four-Ball Extreme Pressure Test and also lower in anti-seizure load in Falex Seizure Test. It is, therefore, found that lack of the S/P balance causes problems.

The invention claimed is:

1. A lubricating oil composition comprising a base oil having a sulfur content of 0.01 percent by mass or less and on the basis of the total mass of the composition:

(A) 0.05 percent by mass or more and 1.5 percent by mass or less of a polysulfide;

(B) 0.05 percent by mass or more and 1.5 percent by mass of thiadiazole; and (C) 0.1 percent by mass of a phosphorus-containing additive, and containing sulfur in an amount of 0.2 percent by mass or more on the basis of sulfur and phosphorus in an amount of 0.2 percent by mass or less on the basis of phosphorus, the ratio of the sulfur basis percent by mass/the phosphorus basis percent by mass (S/P) being from 3.0 to 4.8, wherein (A) the polysulfide is a sulfurized olefin represented by formula (1):

$$R^1—S_X—R^2 \quad (1)$$

wherein $R^1$ is an alkenyl group having 2 to 15 carbon atoms, $R^2$ is an alkyl or alkenyl group having 2 to 15 carbon atoms, and x is an integer of 4 to 8.

2. The lubricating oil composition according to claim 1, wherein (A) the polysulfide is a sulfurized olefin represented by formula (1):

$$R^1—S_X—R^2 \quad (1)$$

wherein $R^1$ is an alkenyl group having 2 to 15 carbon atoms, $R^2$ is an alkyl or alkenyl group having 2 to 15 carbon atoms, and x is an integer of 4 to 8.

3. The lubricating oil composition according to claim 1, wherein (C) the phosphorus-containing additive is at least one selected from a phosphorous acid ester having an (alkyl)aryl group of 6 to 7 carbon atoms and a phosphorous acid ester having an alkyl group of 4 to 8 carbon atoms.

4. The lubricating oil composition according to claim 2, wherein (C) the phosphorus-containing additive is at least one selected from a phosphorous acid ester having an (alkyl)aryl group of 6 to 7 carbon atoms and a phosphorous acid ester having an alkyl group of 4 to 8 carbon atoms.

* * * * *